US011389705B2

(12) United States Patent
de Lanauze et al.

(10) Patent No.: US 11,389,705 B2
(45) Date of Patent: Jul. 19, 2022

(54) HOCKEY TRAINING BOARD FOR PUCK HANDLING AND SHOOTING

(71) Applicant: Christian T. de Lanauze, Chicago, IL (US)

(72) Inventors: Christian T de Lanauze, Chicago, IL (US); Thomas Schnell, Jr., Chicago, IL (US); Michael Graef, Naperville, IL (US); Edward Eaton, Eola, IL (US)

( * ) Notice: Subject to any disclaimer, the term of this patent is extended or adjusted under 35 U.S.C. 154(b) by 0 days.

(21) Appl. No.: 17/075,673

(22) Filed: Oct. 20, 2020

(65) Prior Publication Data

US 2022/0118331 A1 Apr. 21, 2022

(51) Int. Cl.

| | |
|---|---|
| ***A63B 69/00*** | (2006.01) |
| *A63B 102/24* | (2015.01) |
| *A63B 102/22* | (2015.01) |

(52) U.S. Cl.

CPC ..... *A63B 69/0024* (2013.01); *A63B 69/0026* (2013.01); *A63B 2102/22* (2015.10); *A63B 2102/24* (2015.10)

(58) Field of Classification Search

CPC .. A63B 69/0024–0026; A63B 69/3621; A63B 69/3676

See application file for complete search history.

(56) References Cited

U.S. PATENT DOCUMENTS 4,113,258 A * 9/1978 Midana ..... A63B 69/3667 473/218
4,900,030 A * 2/1990 Houtz ..... A63B 69/36211 473/258
5,131,659 A * 7/1992 Lindberg, Jr. ..... A63B 24/0003 473/267
5,249,797 A * 10/1993 Dowhy ..... A63B 24/0021 473/155
5,586,945 A * 12/1996 Vonderhaar ..... A63B 69/3676 473/258
6,364,790 B1 * 4/2002 Carrie ..... A63B 69/00 473/278
6,729,968 B2 * 5/2004 Port ..... A63B 69/3676 473/261
6,846,252 B2 * 1/2005 Nudo ..... A63B 47/002 473/278
7,597,632 B2 * 10/2009 Edwards ..... A63B 69/3676 473/265
8,424,830 B2 * 4/2013 Yang ..... A47B 23/044 248/459
8,529,364 B1 * 9/2013 De Anda ..... A63B 69/3676 473/220

(Continued)

OTHER PUBLICATIONS

"Best Stickhandling Trainer? SuperDeker or Hockey Revolution—Which training aid should you buy", YouTube, uploaded by Hockey Tutorial on Jan. 30, 2019, www.youtube.com/watch?v=1iUKy8mfFMw (Year: 2019).*

*Primary Examiner* — Laura Davison

(57) ABSTRACT

The present invention is a training apparatus and method-of-use for developing a hockey player's stick handling techniques to carry the puck forward and perform a variety of shots. The apparatus includes a collapsible platform which is utilized by athletes and trainers that includes drills and guides that promote stickhandling skills, teach proper techniques in four different categories of shooting, and encourage correct posture for skating and stickhandling motion.

6 Claims, 8 Drawing Sheets

(56) References Cited

U.S. PATENT DOCUMENTS

| | | | | |
|---|---|---|---|---|
| 8,640,864 | B2 * | 2/2014 | Chen | G06F 1/1626 206/45.2 |
| 8,820,695 | B2 * | 9/2014 | Nakada | A45C 13/1069 248/454 |
| 10,076,695 | B1 * | 9/2018 | Simon | A63B 69/0026 |
| 2002/0119845 | A1 * | 8/2002 | O'Farrell | A63B 69/0026 473/588 |
| 2009/0118028 | A1 * | 5/2009 | Tischler, II | A63B 69/36211 473/240 |
| 2014/0256476 | A1 * | 9/2014 | Sallinen | A63B 69/0026 473/446 |

* cited by examiner

HOCKEY TRAINING BOARD FOR PUCK HANDLING AND SHOOTING

TECHNICAL FIELD

This disclosure is related to personal training apparatus for the sporting goods industry. More particularly, embodiments disclosed herein outline the construction and method of use for a personal training apparatus for improved stick handling and shooting skills related to field sports, such as hockey, utilizing a stick.

BACKGROUND OF THE DISCLOSURE

Few are born with the natural ability to handle a puck. Athletes who dream of competing in field sports such as hockey must develop skills by training, running drills, and practicing in order to reach their true potential. While training, players of varying ages may develop improper stickhandling and shooting techniques due to improper athletic posture, incorrect hand placement on the hockey stick, or an athletic misinterpretation on how to athletically perform varying techniques correctly.

There are a variety of techniques related to stickhandling which must be executed with precise timing to carry the puck forward and perform a variety of shots (such as wrist, backhand, snap, and slapshots). Poor form or the lack of knowledge on how to execute a proper technique usually results in a loss of control which is exemplified by the path of the puck being incongruent to the execution of proper technique.

Presented herein is a multi-functional hockey training aid for use by players of all levels to improve their shooting and stickhandling abilities. The hockey training aid is designed to facilitate, promote, and teach proper shooting techniques pertaining to the wrist, snap, backhand, and slap shots. It is also designed to facilitate proper fundamentals in stickhandling.

BRIEF DESCRIPTION OF THE DRAWINGS

To facilitate a fuller understanding of the present disclosure, reference is now made to the accompanying drawings, in which like elements are referenced with like numerals. These drawings should not be construed as limiting the present disclosure but are intended to be illustrative only.

DETAILED DESCRIPTION OF EMBODIMENTS

This disclosure provides detailed descriptions of an apparatus and method-of-use of a multifaceted hockey training aid including a configurable panel which includes guides and drills for developing the skill necessary for proper stick handling and forward motion. The construction of the training aid is such that it may be used in multiple configurations to focus on teaching different skills. The apparatus may further be configured to allow for easy storage and mobility.

Figure 1:
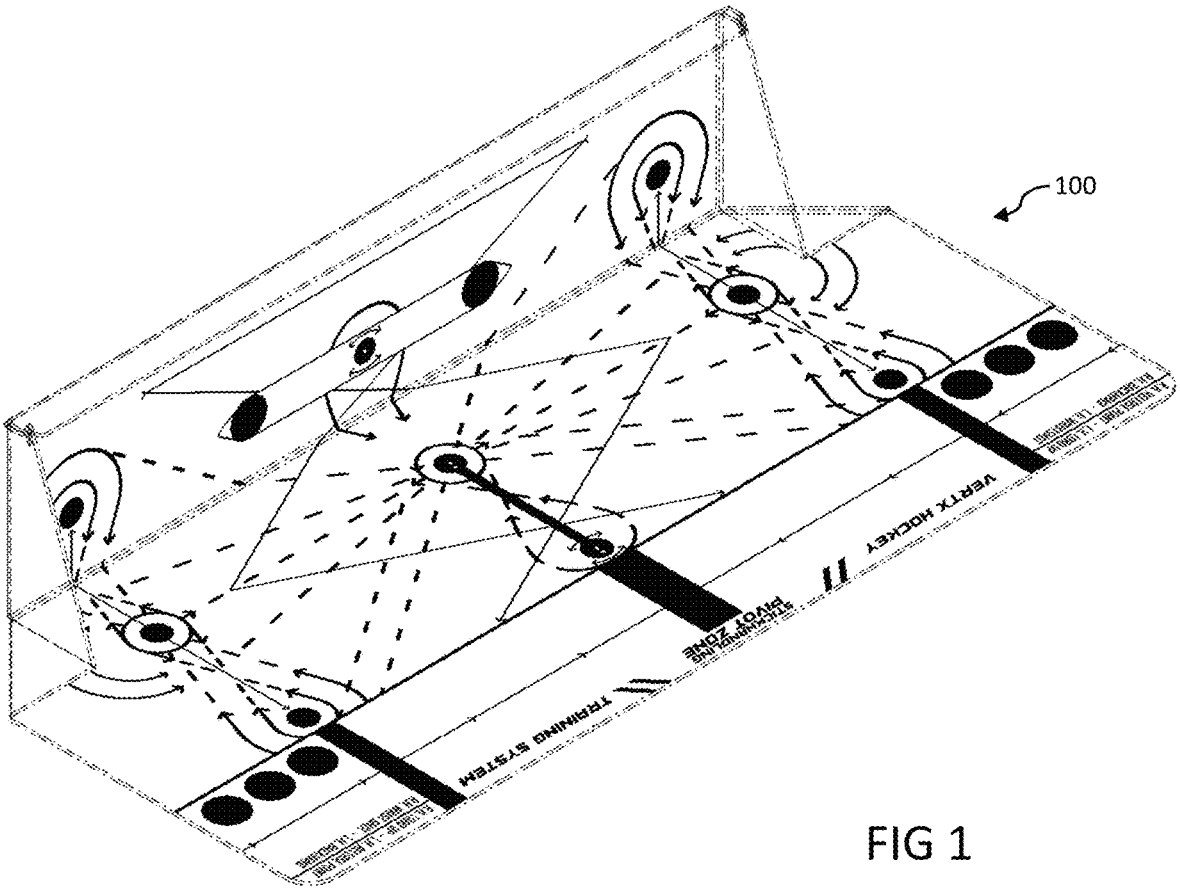
FIG. 1 shows an isometric view of the hockey training board in the shooting configuration.
Figure 2:
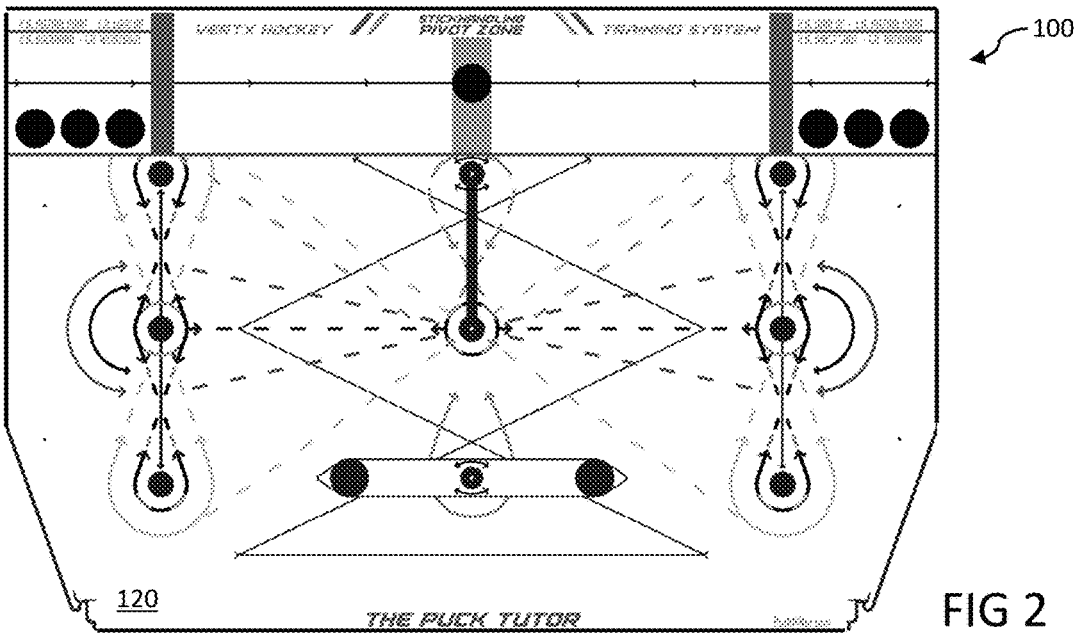
FIG. 2 shows a top view of the hockey training board in the flat configuration including the slap/snap shot zone.

To establish a high-level understanding of the assembled hockey training aid, herein referred to as the training board, FIG. 1 shows the training board 100 in the upright assembled or shooting configuration and FIG. 2 shows the training board 100 in the flat configuration showing the top-side 120 of the board. Both figures include an example of the artwork which makes up various drills to aid in training. The balance of the disclosure will first present the unique physical characteristics of the training board, secondly present the utility of the training board in its various configurations with the associated drill, and finally present methods of use by an athlete for developing proper hockey stick handling skills.

Figure 3:
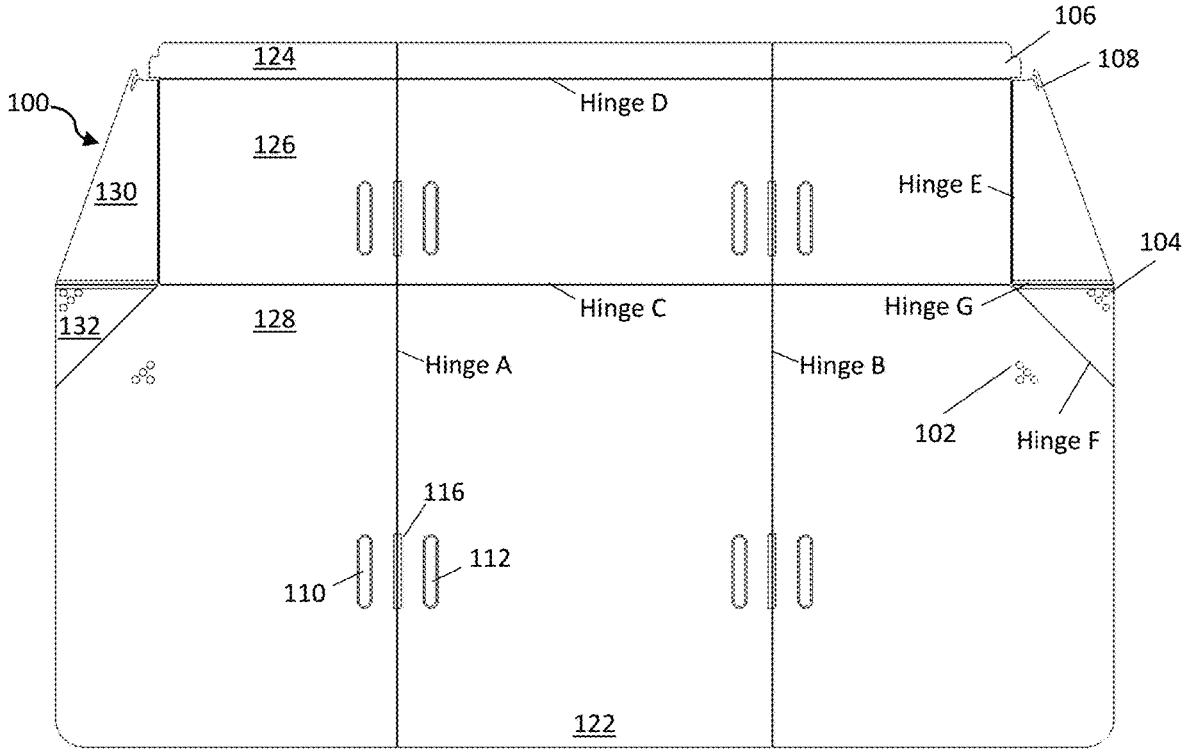
FIG. 3 shows a bottom view of the hockey training board in the flat configuration.

A bottom view of the training board 100 shows the major elements of the construction are shown in FIG. 3. The bottom side 122 of the board includes a number of living hinges, cut-outs, and features to enable transformation between the flat position to the shooting configuration. Other features shown in FIG. 3 enable the training board 100 to be configured in a folded configuration for transport.

In the primary embodiment, the training board 100 in a flat configuration is a single panel approximately four feet across a longitudinal axis by six feet across the lateral axis. The vertical axis is thereby defined by the thickness of the material. In the primary embodiment mechanical features of the board are generally mirrored across the longitudinal axis, therefore, descriptions of features appearing on the right side of the drawings also pertain to features on the left side.

In the preferred embodiment, the board is constructed of a single sheet of plastic which behaves in this application similar to synthetic ice and having properties of high durability, manufacturability, and low friction (having a generally smooth finish). In some embodiment, these requirements are met with a generic HDPE or High-Density Polyethylene.

In some embodiments, to further reduce surface friction and skate blade wear, the single sheet may be constructed of an ultra-high molecular weight polyethylene (UHMW-PE) such as those manufactured as synthetic ice under brand names Glice, Xtraice, or PolyGlide Ice. In other embodiments, it may be constructed from materials such as polyoxymethylene plastic.

As shown in FIG. 3, the bottom-side 122 of the training board can be broken in to three regions defined by the lateral boundaries of Hinge D and Hinge C. At the upper or distal end of the board, defined by the border of Hinge D and the distal perimeter of the board, is the guide wall 124. A middle wall 126 is defined by lateral Hinges C and D and the longitudinal Hinges E and its mirrored image. The lower wall 128 is defined by Hinge C, Hinge F and its mirror image, and the proximal perimeter of the board. Additionally, two triangular sections (appearing on both sides) aid in securing the training boards in its constructed configuration; the upper triangle bound by Hinge E, Hinge C, and the board perimeter, and the lower triangle 132 bound by Hinge C, Hinge F, and the board perimeter.

To aid in the transportation and storage of the device, Hinge A and Hinge B enable the training board to be folded into thirds. To further aid in mobility, four pairs of recesses in the material shown at 110 and 112 provide handles allowing the user to grasp and hold the training board between their fingers and thumb. An additional groove 116 exists along Hinge A and Hinge B and between the recesses 110 and 112 to reduce the tension of the hinge between the recessed handles 110 and 112 when folded.

At the lateral ends of the guide wall 124 are tabs 106 which are designed to mate with the receiving slots 108 on the upper triangle 130 when board is shooting configuration with the guide wall and middle wall being perpendicular to each other.

Another retaining arrangement utilized when the training board is in the shooting configuration appearing in FIG. 3 are the plurality of mating devices 102 and 104 appearing on the lower triangle 132 and the lower wall 128. The mating devices 104 are arranged such that they correspond with the mirrored arrangement across Hinge F. In the primary embodiment, the mating devices 102 and 104 are magnetic fasteners which are paired devices having a ferromagnetic attraction. This may include, for example, a pair of magnets 134 having opposing polarities, or magnets placed in the cavities appearing at 104 and a ferromagnetic metal residing in the cavities appearing at 102, or a ferromagnetic metal residing in the activities at 104 and magnets appearing in the cavities appearing at 102. Another embodiment may include any variety of mechanical fasteners at these locations such as snaps, screws, clips, or other method which secures the lower triangle 132 to the lower wall 128.

Figure 4:
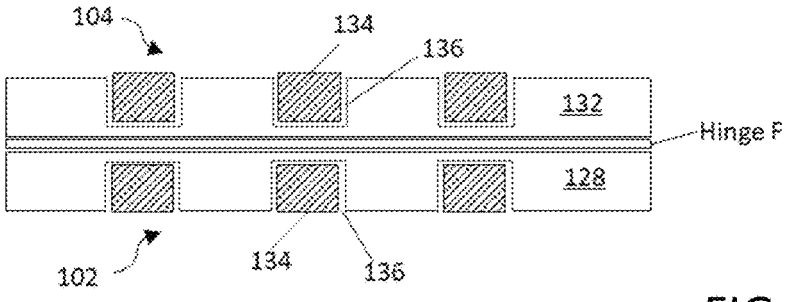
FIG. 4 shows a cross section of the magnetic fasters of the hockey training board.
Figure 5:
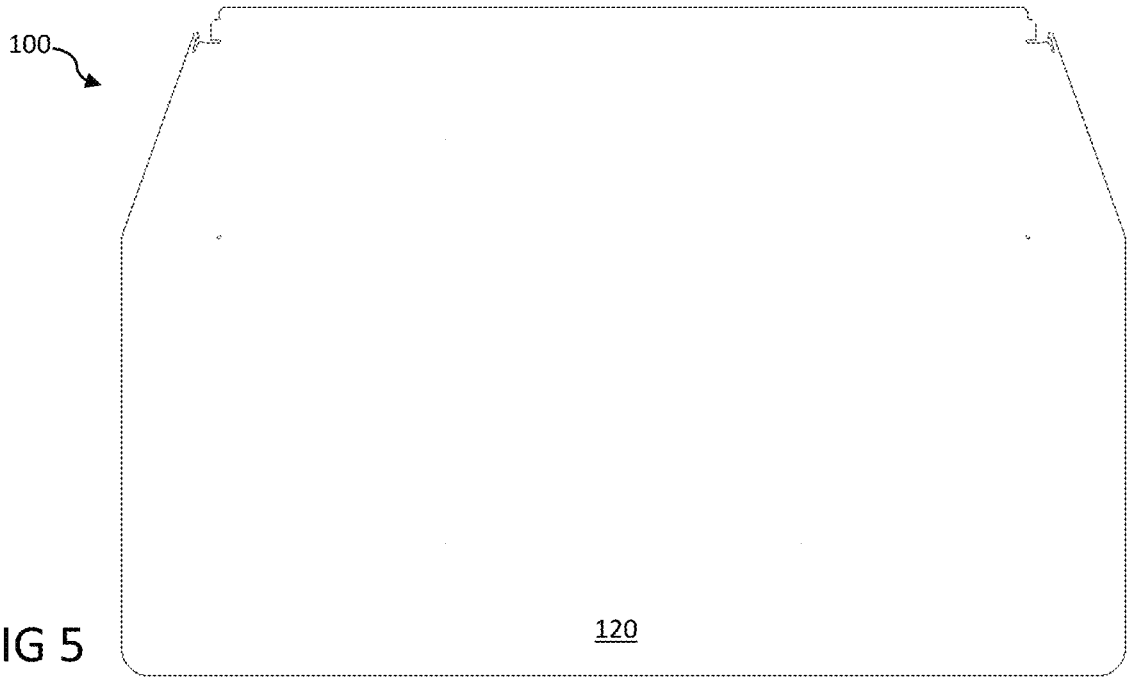
FIG. 5 shows a top view of the hockey training board without artwork.

FIG. 4 shows a cross sectional view of the primary embodiment of the mating device 102 and 104 when the training board is assembled in the shooting configuration and the surfaces of the lower wall 128 and lower triangle 132 are in communication. As shown, a series of cavities 136 exist in the material of the lower wall and lower triangle (128 and 132), and a plurality of magnets 134 are positioned within the cavity. This arrangement is beneficial as the mating devices are neither visible or mechanically apparent on the upper surface 120 of the training aid 100, as shown in FIG. 5, which will be utilized for drills and graphics.

Figure 6:
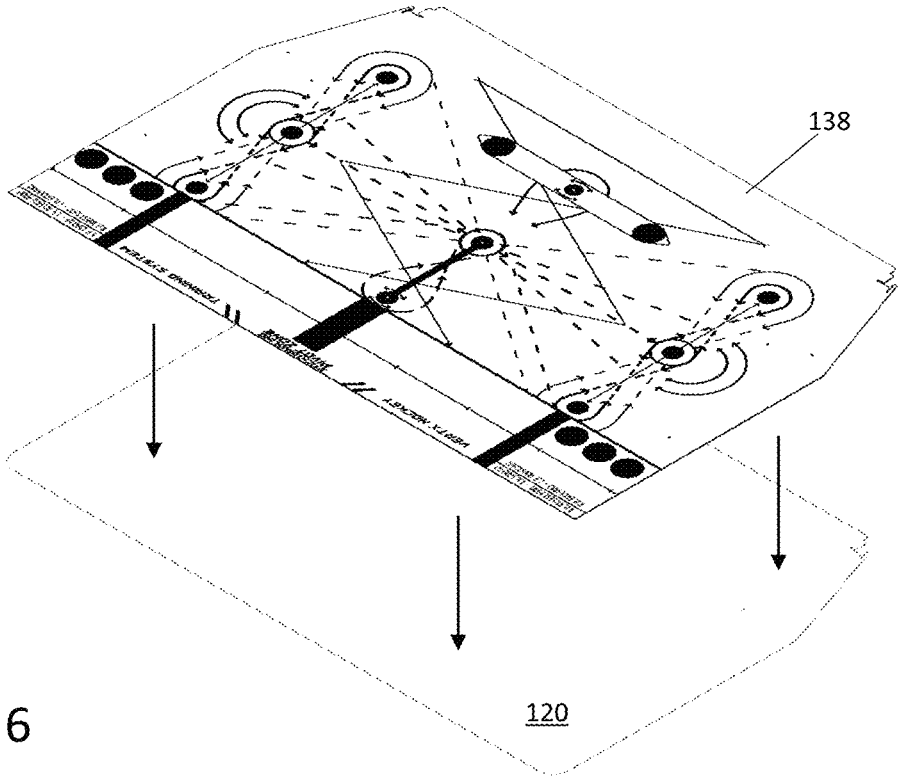
FIG. 6 shows the application of artwork to the hockey training board.

FIG. 6 demonstrates the application of the hockey drill 138 to the upper surface 120 of the training board. The drill, as shown, is targeted to an athlete participating in hockey, however, it is understood that the drill may be applied to various sports involving handling of a puck or ball. To maintain the low surface friction of the HDPE or synthetic ice, it is desirable to print directly onto the material. In some embodiments, the drill may be applied via a sticker or constitute a secondary layer which is adhered to the board.

Figure 7:
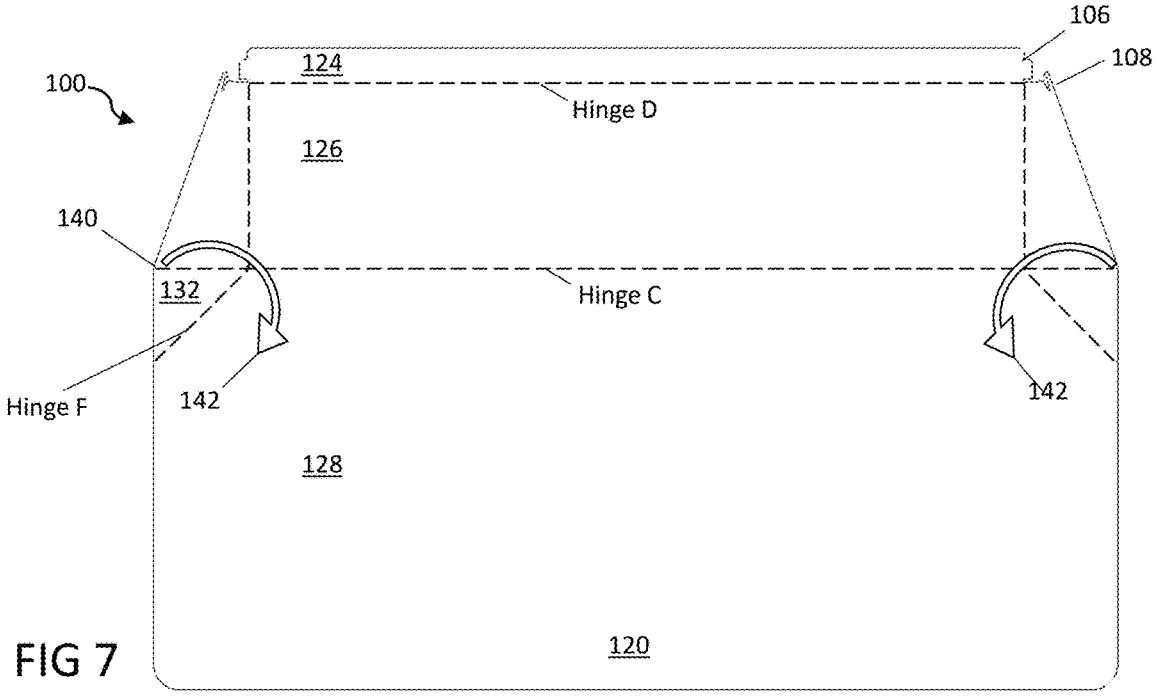
FIG. 7 shows the transformation of the training board from the flat configuration to the shooting configuration.

Assembly of the training board begins with the unit lying flat with the top-side 120 facing up, as shown in FIG. 7. Subsequently, the apex 140 of the lower triangle is folded across Hinge F as indicated by transitional arrow 142. Several actions occur in completing this fold. First, the surface of the lower triangle 132 comes into contact with the upper surface of the lower wall. Secondly, the fastening mechanism 102 and 104 come into proximity and may engage (either passively in the case of a magnetic force or actively in the case of a mechanical fastener such as snaps, latch and hook, etc). Third, the action pulls the middle wall 126 and the upper triangle 130 into a perpendicular position relative to the lower wall. This transition 142 and events take place on both sides in general unison.

Assembly continues with the guide wall 124 being folded 90 degrees across Hinge D such that the tab 106 and receiving slots 108 mechanically engage, again on both sides, and thereby creating a perpendicular angle between the guide wall 124 and the middle wall 126.

Figure 8:
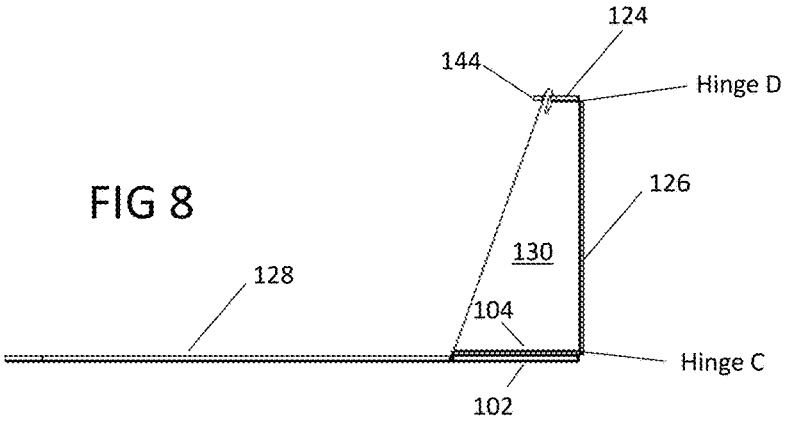
FIG. 8 shows a side view of the hockey training board in the shooting configuration.
Figure 9:
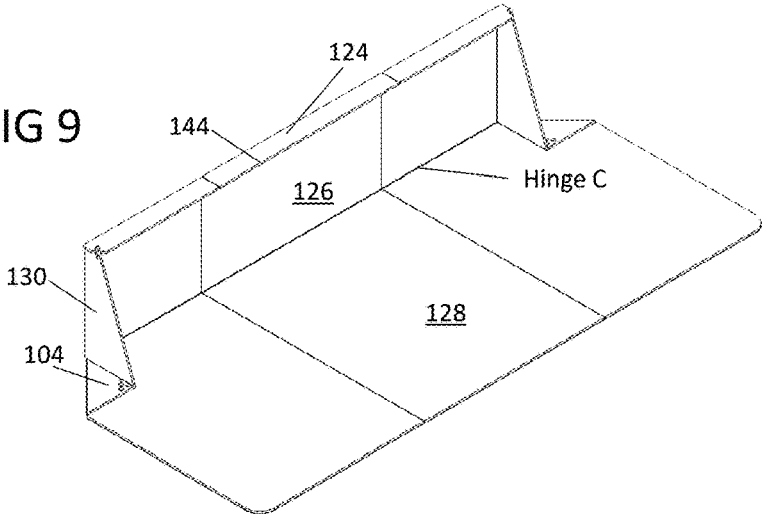
FIG. 9 shows an isometric view of the hockey training board in the shooting configuration.

The resulting assembly showing the relationship of the surfaces is shown from the lateral side-view in FIG. 8 and isometric view in FIG. 9. Also shown are the alignment of the fasteners 102 and 104 in the assembled shooting configuration, and the leading edge of the guide wall 124 (herein referred to as the guide bar 144).

In some embodiments, the guide bar 144 may be an elongated member, such as a rod, supported by the middle wall 126 or extending between side supports (such as atop the acute angle of the upper triangle 130). In some embodiments, the guide bar 144 may simply be the edge created by the middle wall 126.

Figure 10:
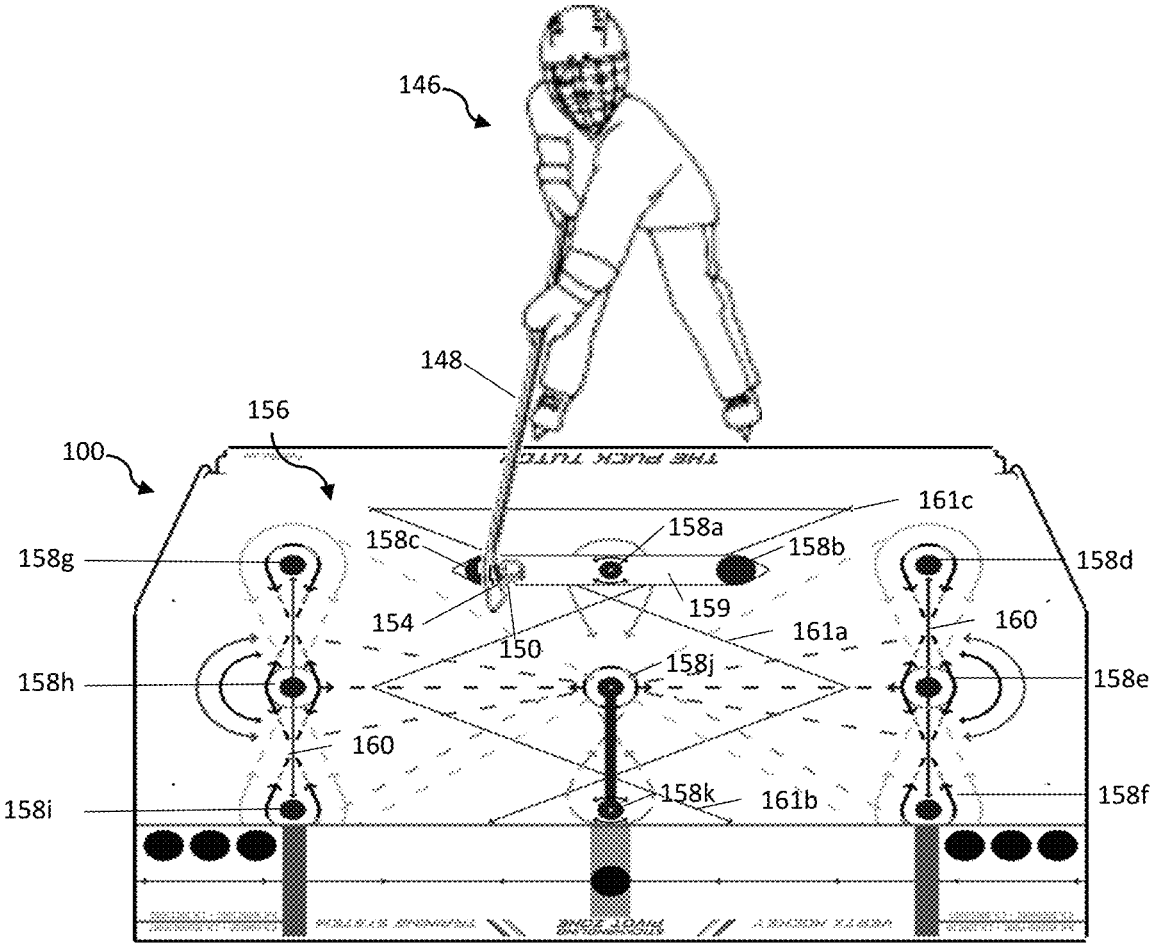
FIG. 10 shows the use of the hockey training board in the flat configuration.

FIG. 10 shows a player 146 utilizing the training board 100 in the flat configuration. The training board 100 may have multiple combinations of different skills sets drawn on to the face of the board that make up a number varying patterns for a hockey player 146 to follow to improve their stickhandling motions, develop core strength using the training resistance material of the board, and all categories of the shooting.

In some embodiments, multiple patterns 156 teaching a variety of skills may be printed onto the training board as shown in FIG. 10. These patterns are provided as a primary embodiment but are non-limiting examples as other patterns may exist.

To work on lateral stick handling for example, the player 146 faces the board, positions the puck 150 on the training board at location **158*j* and uses the stick 148 to traverse the puck laterally between the two outside puck markers 158*h* and 158*e*. In a similar method, to work on either righthanded or lefthanded vertical figure eights, a pattern exists wherein the player 146 places the puck 150 at a starting location and uses the stick 148 to traverse the puck 150 in and around a longitudinal line 160 between puck markers 158*g* and 158*i* for a wide figure eight. In a similar method, to work on either right handed or left handed figure eights can be found when the player 146 weaves the puck 150 between puck markers of 158*d*, 158*e*, and 158*f*** creating a narrower figure 8 for a combination of overlapping figure 8's.

In some embodiment, as another example, multiple patterns of figure 8's can be performed by the player 146 using the stick 148 to maneuver the puck 150 in figure 8 patterns in and around horizontal puck markers **158*h* and 158*e* both on the forehand and backhand of the stick blade. Meaning if the puck is placed marker 158*j*, the player 146 could traverse the puck 150 starting towards the top or bottom of 158*h* or 158*e* to practice varying patterns of wide figure 8's. Also, as another example, the player 146 using the stick 148 to a maneuver puck 150 in and around 158*h*, 158*j*, and 158*e*** for a combination of overlapping figure 8's.

Additionally, vertical figure eights may be accomplished as previously described, starting at either left **158*d* or right 158*g* to 158*i* to 158*f* and then diagonally coming across at a 45-degree angle back to 158*d* or 158*g***.

Another specific pattern can be found, for example, where the stick 148 opens the blade 154 pushes the puck 150 north up the linear line 160 and then turns the stick 148 over to the toe of the blade 154 bringing the puck south. This can be practiced both left and right hand north and south of line 160.

Another drill which may be performed using the markings shown is the diamond V pattern indicated by 161 and comprising of a central diamond 161*a* with each side extended to form an upper 161*b* and lower triangle 161*c*. Using this pattern, a player 146 can simulate stick handling and skating both forward and backward motions, thus providing the player 146 a specific diamond-type path for the puck to follow.

Also, the slap/snap shot zone 159 is specifically designed to teach a player 146 how to take proper snaps shots and slap shots. For the slap shot, the design of the two puck indicia (shown at 158*c* and 158*b*) inside the slap/snap shot zone 159 is specifically placed at opposite ends of the snap/slap shot zone with 24 inches of spacing between the indicia. For example, a right hand shot places a puck 150 at point 158*c*.

Figure 11:
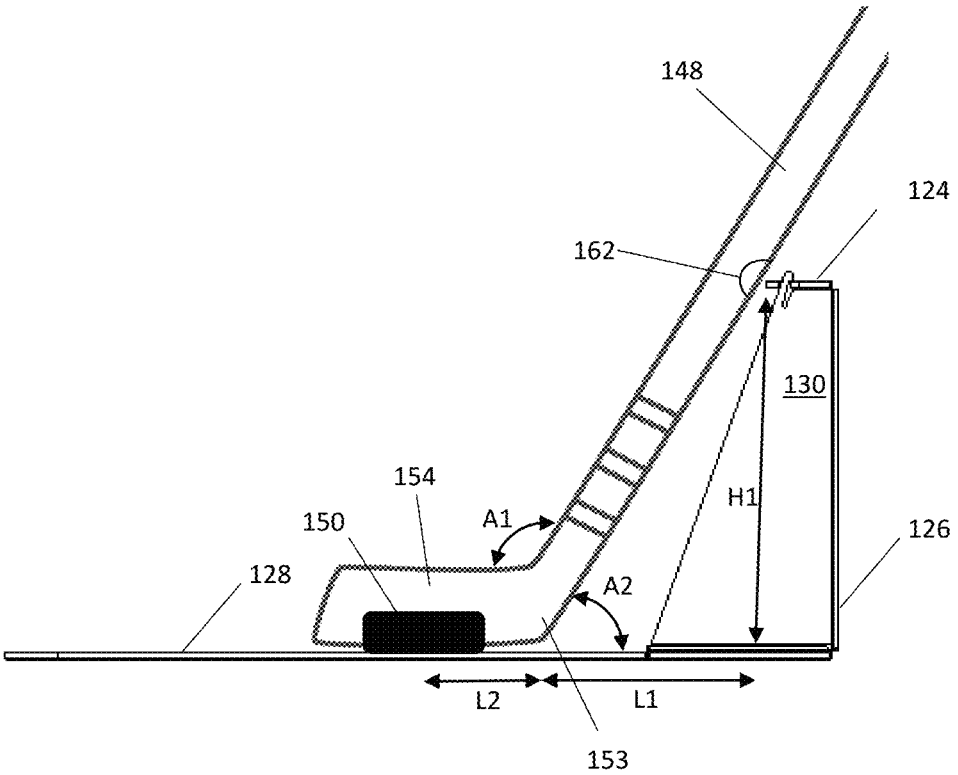
FIG. 11 shows the vertex formed by the hockey training board and stick in the shooting configuration.

FIG. 11 is a side view showing how the guide bar 144 interacts with the shaft of the stick 148 to help players develop better shooting skills. The puck 150 positioned on the lower wall 128, the player stands opposite the stick 148 and behind the middle wall 126. The player then latterly follows the leading-edge of the guide bar 144 with a contact point on the shaft of the stick 148. In the FIG. 11, the contact point on the stick is shown as the semi-circular area defined as 162 for illustrative purposes, however, this area should be minimized to a small horizontal area on the back of the stick 148 when correctly demonstrating stick control.

For optimal performance, a blade 154 of a hockey stick should rest against the surface with the puck 150 centrally cradled within the curvature of the blade (given as length L2). Hockey sticks 148 are given a lie value which refers to the angle between the shaft and the blade (shown as A1). A lie of 5 corresponds to an angle of 135 degrees; with each additional lie decreasing angle by 2 degrees, thus increase the vertical orientation. Typical sticks are manufactured between 4 to 7 lie or having an angle A1 of 137 to 131 degrees respectively. The complimentary stick angle A2 therefore ranges from 43 to 49 degrees across the range of lie 4 to 7. To account for variance due to cupping of the puck during a shot, a slight variation may exist opening the angle A2 to 40 to 51 degrees. The typical length of a hockey stick blade is 9.8 to 15.7 inches or 25 to 40 cm.

The height H1 of the leading edge of the guide bar 144, stick angle A2, and the ideal position of the center of the puck 150 which is shown on the training drill artwork is mathematically related by trigonometric functions. In the preferred embodiment, the ideal horizontal location for the puck 150 from the leading edge of the guide bar 144 and therefore corresponding drill artwork is derived given the lie of the hockey stick and height of the guide bar 144. For example, a hockey stick with a blade length of 10 inches would stipulate that the central point of the blade is L2 is halfway or 5 inches from the vertex between the lower surface 128 and the shaft of the stick 148. Additionally, given the hockey stick has a lie of 4 or 137 degrees, it can be deduced that the complementary angle at this vertex is 43 degrees. Finally, given the height of the leading edge of the guide bar 144 is 14.5 inches above the surface and that the leading edge is in communication with the area on the stick 162, the distance L1 is given by the height H1 divided by the tangent of A2 plus L2, or 18.52 inches.

As shown in FIG. 11 a right-triangle is formed by a first leg, shown as H1, and defined by the perpendicular distance between the guide and the horizontal surface, a second leg, shown as L1, defined by the distance between the heel of the hockey stick and the intersection of the first leg along the lower surface 128, and a hypotenuse defined by the shaft of the hockey stick between the heel 153 and the area 162 where the shaft rests upon the guide 124. During lateral movement of the hockey stick along the guide bar, when the stick does not change orientation, a right right-triangle prism is formed by extending the right-triangle.

To summarize, in the preferred embodiment the puck location and corresponding artwork on the training board is a trigonometric function of the height of the leading edge of the guide bar and the stick characteristics of lie and blade length—given that the guide bar and stick are in communication. The central point of the puck on the surface of training board relative to the leading edge of the guide bar is defined by the height of the guide bar divided by the tangent of the complimentary angle associated with the lie plus half the length of the blade.

In the preferred embodiment, the height of guide wall H1 is 14.25 inches above the surface of the lower wall, the preferred angle A2 is 41.7 degrees, and the contact point is 21.42 inches up along the shaft of the hockey stick from the lower wall. A smaller guide wall height H1 would have less influence in guiding the stick, while a higher guide wall greater than 14.25 interfered with the hand bottom hand placement of smaller players on the hockey stick. In practice, the height of the guide wall H1 may be as low as 10 inches for smaller players and in some embodiments, specifically for larger players, the height H1 can increase up to 18 inches.

Figure 12:
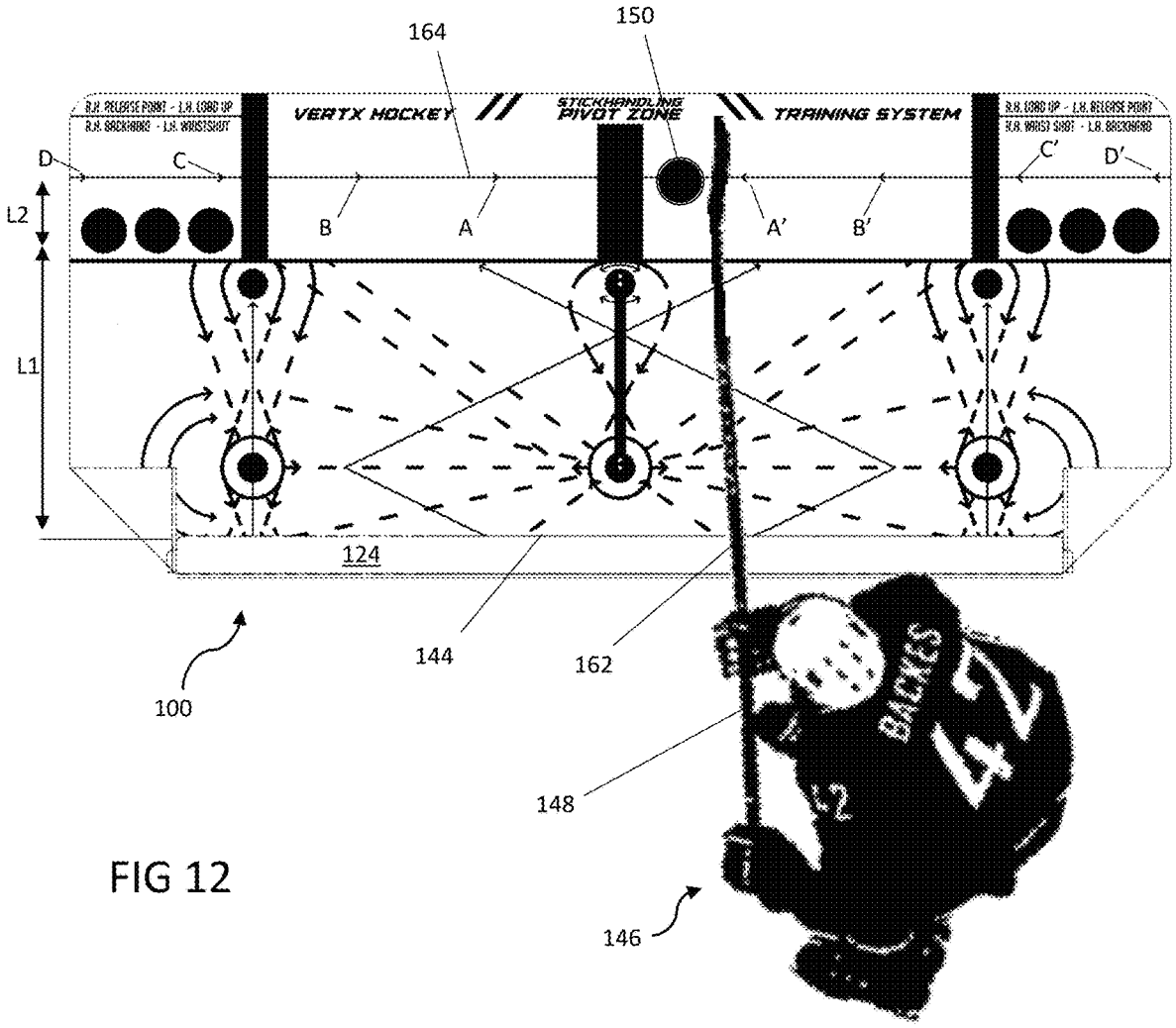
FIG. 12 shows a top view of the hockey training board, player, and stick in the shooting configuration.

FIG. 12 shows an overhead view of the training board 100 in the shooting configuration and being used by a player 146. The contact area 162 of the player's stick 148 is in communication with the leading edge of the guide bar 144. Ideally the contact area is minimized to a point on the stick during proper execution of shooting drill. The puck 150 is centrally in line with the puck guide path artwork 164. The horizontal distance between the leading edge of the guide bar 144 and the guide path artwork 164 is shown by the combination of L1 and L2.

When a player 146 is practicing his/her wrist or back hand shot, the guide bar 144 promotes proper shooting technique combined with target accuracy. As the guide bar 144 continues to be in communication with the specific point 162 of the hockey stick 148 shaft while shooting the puck 150, the puck will also travel in linear fashion following the line of accuracy 164 so that the player 146 hits the same target a 100% of the time.

The line of accuracy 164 of the hockey training board 100 promote varying widths of stickhandling between four points—A to A', B to B', C to C', and D to D'. Though the pattern may vary from point-to-point, or arrow to arrow (via the design). When a player 146 is traversing the puck 150 along the line of accuracy 164 in a repetitive sequence, it is developing the player's 146 core strength.

Figure 13:
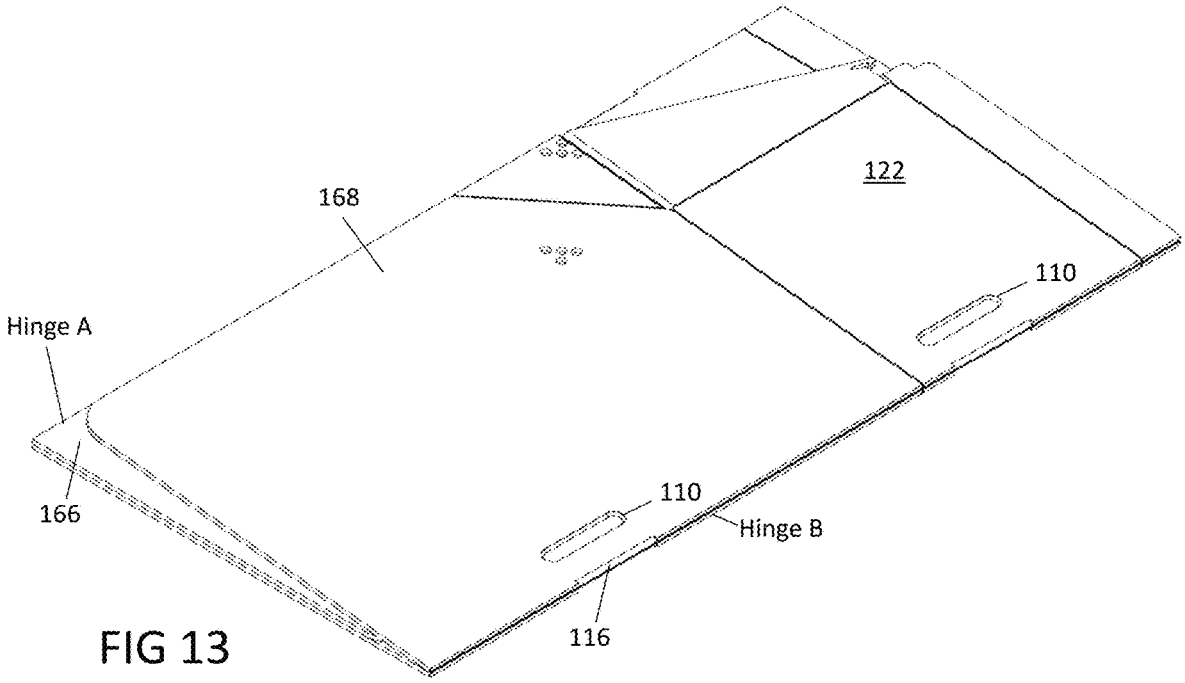
FIG. 13 shows the hockey training board in the folded configuration.

The hockey training board 100 may also be folded down for storage and transport as shown in FIG. 13 (folding configuration). As shown Hinges A allows a first section 166 to be folded over and then Hinge B allows a second section 168 to be folded over; it should be understood that alternatively Hinge B could have been employed before Hinge A to produce nearly identical results. Also shown are recesses 110 which are opposite recesses 112 (not shown) which together act as handles for transport. A plurality of cavities 116 positioned along the hinges and laterally between the opposing recesses 110 and 112 further aid in allowing the first and second sections to fold by the handles.

What is claimed is:

1. A hockey training aid for developing stick handling skills comprising a horizontal lower wall, a horizontal guide wall defining, a guide bar parallel to the lower wall, and vertical members comprising a middle wall and two side walls that support the guide wall at a fixed height above the lower wall, wherein the guide bar is defined by an edge of the guide wall opposite the middle wall;

wherein the guide bar is configured to contact a point on a shaft of a hockey stick and the lower wall is configured to contact a blade of the hockey stick to orient the hockey stick for developing stick handling skills; and;

wherein the lower wall, vertical members, and guide wall are constructed from a single sheet of rigid plastic having a plurality of mechanical hinges allowing the training aid to transform into a flat sheet.

2. The hockey training aid of claim 1 wherein the height of the guide wall is between 13 and 15 inches from the horizontal lower wall.

3. The hockey training aid of claim 1 wherein indicia on the horizontal lower wall shows a location for placement of a hockey puck, a linear extension from said location indicating a desired direction of travel of the hockey puck, and wherein the linear extension is parallel to the guide bar.

4. The hockey training aid of claim 3 wherein additional indicia exists along the linear extension to promote multiple point-to-point widths of stick handling.

5. The hockey training aid of claim 1 wherein hockey training drills are defined by patterns on the lower wall and provide a path for a player to traverse a hockey puck along using a hockey stick.

6. The hockey training aid of claim 5 wherein the hockey training drills include multiple patterns including figure 8's, diamond V, and a slap shot zone.

* * * * *